US005437713A

United States Patent [19]

Chang

[11] Patent Number: 5,437,713

[45] Date of Patent: Aug. 1, 1995

[54] REMOVAL DEVICE FOR ELECTROSTATIC PRECIPITATORS

[76] Inventor: Chin-Chu Chang, No. 243, Sec. 2, Feng Shih Road, Feng Yuan City, Taichung Hsien, Taiwan

[21] Appl. No.: 352,778

[22] Filed: Dec. 1, 1994

[51] Int. Cl.[6] ..... B03C 3/74

[52] U.S. Cl. ..... 96/51; 95/76; 96/87

[58] Field of Search ..... 96/51, 28, 86, 87, 33, 96/39, 40, 94; 95/76, 77, 74; 55/296

[56] References Cited

U.S. PATENT DOCUMENTS 1,843,510 2/1932 Hale ..... 95/76
1,869,335 7/1932 Day ..... 95/76 X
2,964,126 12/1960 Peterson ..... 96/28
4,726,814 2/1988 Weitman ..... 96/51 X
5,110,324 5/1992 Testone et al. ..... 95/76 X

*Primary Examiner*—Richard L. Chiesa
*Attorney, Agent, or Firm*—Morton J. Rosenberg; David I. Klein

[57] ABSTRACT

A removal device for an electrostatic precipitator which includes an ion generator, precipitator, collector and removal device for removing particles in the precipitator. A plurality of scrapers capable of linear displacement between two adjacent electrostatic plates of opposite polarities remove particles adhered thereto and scraped particles are collected in the collector for subsequent handling.

8 Claims, 7 Drawing Sheets

REMOVAL DEVICE FOR ELECTROSTATIC PRECIPITATORS

BACKGROUND OF THE INVENTION (a) Field of the Invention

The present invention relates generally to a removal device for electrostatic precipitators and more particularly to a removal device which utilizes scrapers capable of linear displacement to remove particles adhered to the surface of electrostatic plates.

(b) Description of the Prior Art

In conventional electrostatic precipitators which are used in handling oil-containing gases, oil-containing particles attracted to electrostatic plates stick themselves thereto due to their own stickiness after their electric charges are neutralized. After a period of time, a layer of oily scum is formed on the electrostatic plates. If the conventional method of electrostatic precipitation which utilizes vibration or washing is adopted to remove the particles on the electrostatic plates, it will not be effective. The oily scum will not be shaken off the electrostatic plates by vibration. If a detergent is added to help wash away the oily scum from the electrostatic plates, the electrostatic plates have to be completely dried after washing before they may be used again. This washing procedure plus the time spent in allowing the electrostatic plates to dry will take a considerably long time, hence this method is not very feasible in working environments like restaurants which require quick and effective removal of oily dirt and scum.

In the earlier U.S. Pat. application Ser. No. 08/273,797 (filed on Jul. 12, 1994), an electrostatic precipitator has been disclosed, in which a plurality of scrapers are employed to match circular electrostatic plates capable of axial rotation to remove scum on the electrostatic plates. But in this kind of prior precipitators, it is necessary to have either the scrapers or the electrostatic plates to be capable of axial rotation, and the electrostatic plates must be circular in shape. This arrangement is therefore ineffective when applied to current rectangular electrostatic plates. In particular, the scrapers are arranged within the collecting zone so that they may affect the overall collecting effect.

SUMMARY OF THE INVENTION

The primary object of the present invention is to provide a removal device for electrostatic precipitators adapted for use in current rectangular electrostatic plates to speedily and efficiently remove oily particles adhered to the electrostatic plates wherein the scrapers are disposed outside of the collecting work domain when the scrapers are not in use.

To achieve the above-mentioned object, the removal device for electrostatic precipitators according to the present invention comprises an ion generator for supplying electric charge to particles in the air, the ion generator consisting of a plurality of electrodes charged with high voltage direct currents and parallel round metal plates, in which an air current is introduced from the front part of the ion generator into the interior of the ion generator; a precipitator for arresting particles in the air, in which the air current flowing from the ion generator past the precipitator flows out through the rear portion of the precipitator, the precipitator consisting of at least one pair of a first electrostatic plate and a second electrostatic plate of opposite polarities equally spaced apart and being parallel to each other, in which the first electrostatic plate is connected to a polarity and the second electrostatic plate is connected to a different polarity; and a collector for collecting particles in the air, wherein the improvement comprises at least a scraper is disposed between the first and second electrostatic plates of the collector, the scraper being parallel to the electrostatic plates with its two ends linked to a vertical driving lever of the electrostatic plates, the scraper bearing a resilient pressure so as to get into contact with an electrostatic plate, and the driving lever linking a drive mechanism which drives the driving lever to perform linear displacement.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
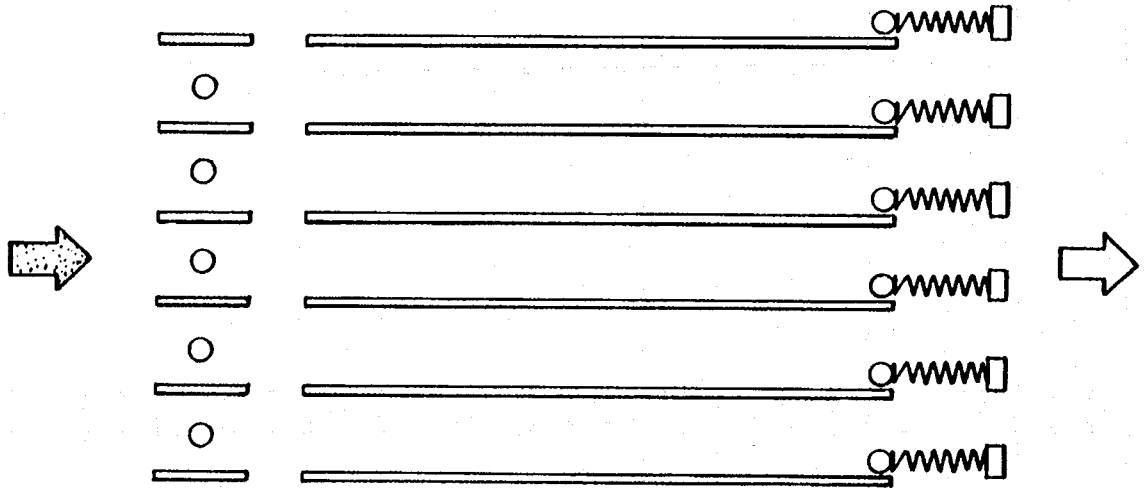
FIG. 1 PRIOR ART
FIG. 1 illustrates the working principle of conventional electrostatic precipitation.
Figure 2:
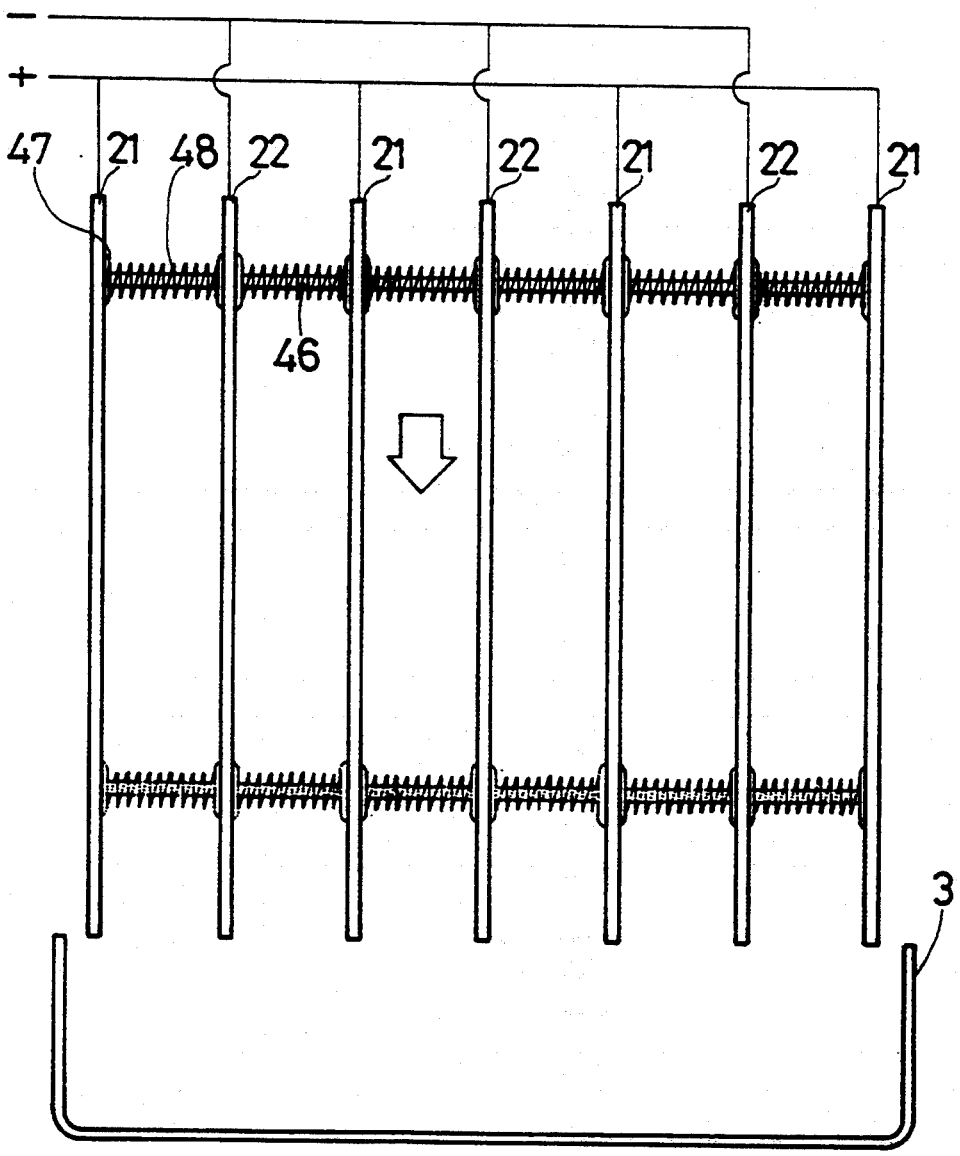
FIG. 2 illustrates the working principle of a first preferred embodiment of the present invention.
Figure 3:
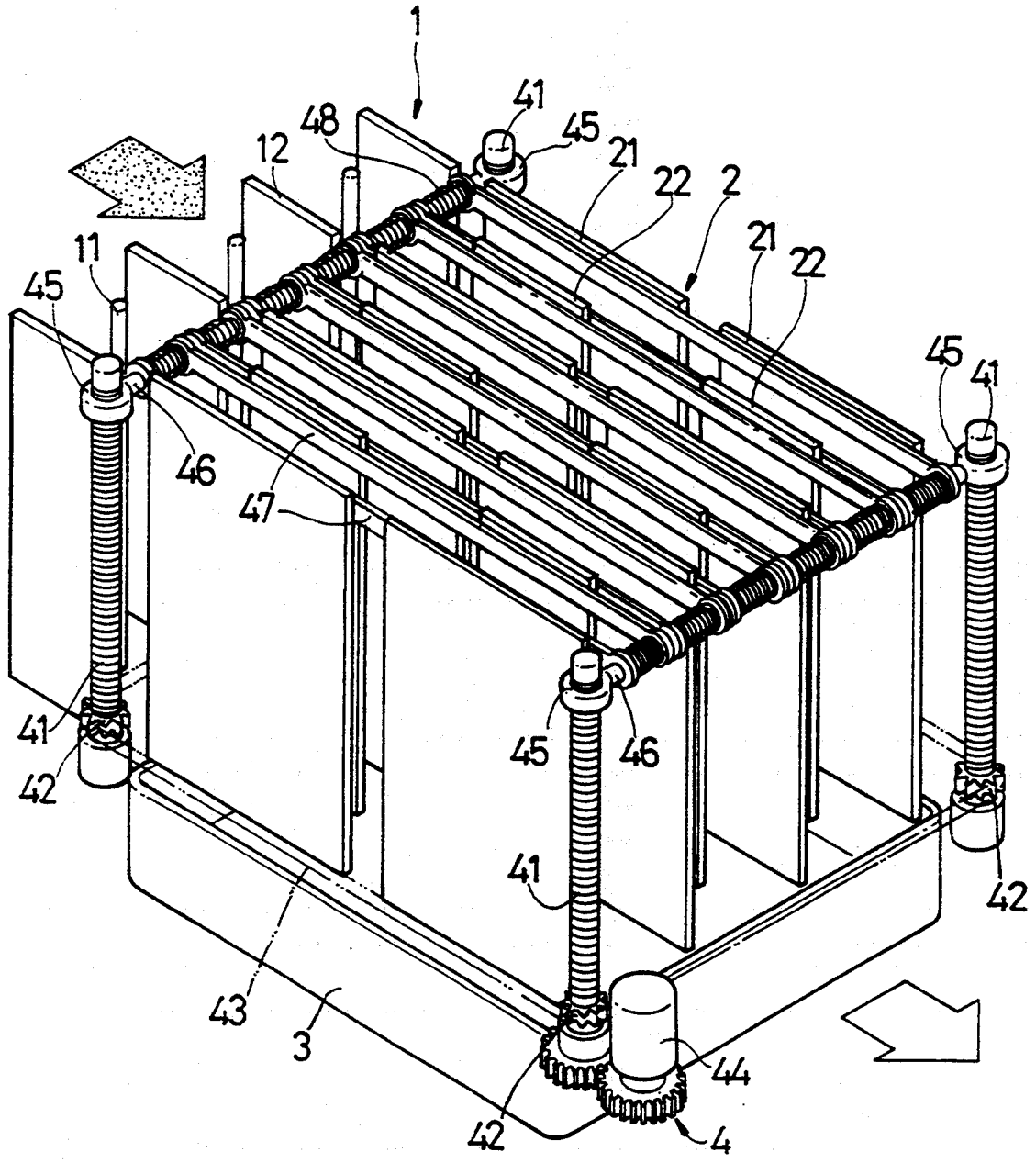
FIG. 3 is a perspective view of the first preferred embodiment of the present invention.
Figure 4:
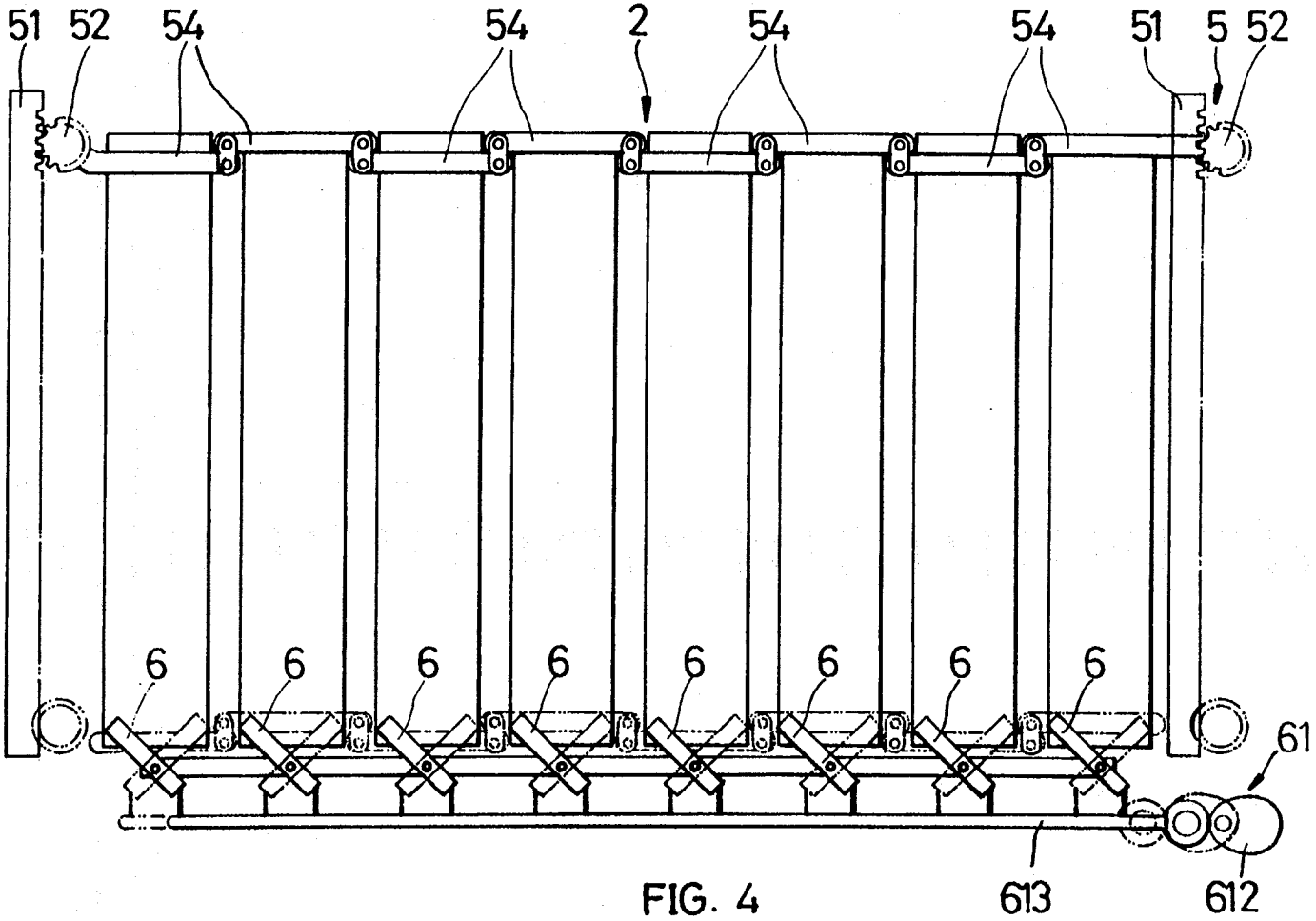
FIG. 4 illustrates the working principle of a second preferred embodiment of the present invention.

With reference to FIGS. 2 to 4, the preferred embodiment of the electrostatic precipitator comprises an ion generator 1, a precipitator 2, a collector 3 and a driving mechanism 4. The ion generator 1 is used for supplying electric charges to particles in the air and is formed of a plurality of electrodes 11 charged with high voltage direct currents and parallel ground metal plates 12, and an air current is introduced from the front of the ion generator 1 into the interior of the ion generator 1; the precipitator 2 is arranged to introduce the air current leaving the ion generator 1 into the precipitator 2 and to remove particles in the air current before it is discharged through the rear side of the precipitator 2, in which the precipitator consists of at least one pair of a first electrostatic plate and a second electrostatic plate 21, 22 of opposite polarities equally spaced apart and parallel to each other, the first electrostatic plate 21 being linked to a positive polarity, and the second electrostatic plate 22 being linked to a negative polarity. The collector 3 is configured to collect particles in the air. In the present embodiments, the driving mechanism 4 consists of four longitudinal screws 41 disposed in the four corners of the precipitator 2, the bottom end of each of the four longitudinal screws 41 is connected to a sprocket 42 and a chain 43 passes the sprockets 42 of all the four screws 41, in which a longitudinal screw 41 is connected to a rotary driving means such as a motor 44. The four longitudinal screws 41 are each provided with a nut 45 disposed at a same level thereon. The four nuts 45 are respectively connected to two driving levers 46 which are perpendicular to the electrostatic plates of the precipitator 2. The two driving levers 46 are connected to a plurality of scrapers 47 connected therewith, the scrapers 47 being respectively provided between adjacent first and second electrostatic plates 21, 22. A resilient body is disposed on the driving lever 46 provided between the scrapers. In the present embodiment, a spring 48 is employed. The two ends of the spring 48 each press against the scraper 47 so that the two scrapers 47 between two adjacent first and second electrostatic plates 21, 22 are pressed against the first and second electrostatic plates 21, 22 respectively. The blades are also caused to displace longitudinally so that its working area completely encompasses the area covered by all the electrostatic plates. When the motor 44 brings a longitudinal screw 41 to perform axial rotation, by means of a chain 43 which connects all the four longitudinal screws 41, all the four longitudinal screws 41 are caused to axially rotate synchronously, hence bringing the two driving levers 46 which are connected to nuts 45 to displace longitudinally, simultaneously causing each scraper 47 to move longitudinally on the first and second electrostatic plates 21, 22.

By means of the above arrangement, when oil-containing smoke enters the ion generator 1, oil-containing particles are ionized into charged particles which then enter an electrostatic field generated by a plurality of first and second electrostatic plates 21, 22 of different polarities and in parallel arrangement, so that the charged particles are subject to the coulombian force and are collected onto the first and second electrostatic plates 21, 22.

After a period of work, the oil-containing particles accumulated on the electrostatic plates increase and form a layer of oily scum which, if thickens, may lower the coulombian force of the electrostatic field, hence losing its attractive function on charged oil-containing particles. Therefore, the oily scum must be removed to maintain the working efficiency of the electrostatic precipitator.

At this time, the motor 44 of the driving mechanism 4 is actuated to cause the four longitudinal screws 41 to perform synchronous axial rotation which may lower the nuts 45 gradually, simultaneously bringing the driving levers 46 and scrapers 47 between the nuts 45 to be lowered, so that the scrapers 47 may proceed with removing the scum on the first and second electrostatic plates 21, 22. Because the area formed by the working track of the scrapers 47 completely encompasses the collecting area of the first and second electrostatic plates 21, 22, the scrapers may slowly perform linear displacement longitudinally while removing scum sticking to the electrostatic plates, and the scum drop to the collector 3 of their own weight. The scum collected in the collector 3 may then be treated together to prevent secondary environmental pollution.

In the precipitator 2 of the first preferred embodiment, due to the arrangement of two parallel electrostatic plates of equal lengths, the scrapers 47 may be interconnected.

In addition, if the distance between the two ends of the scrapers 47 is too long so that the springs 48 at the two ends are unable to press against the middle section of the scrapers 47 to press against the electrostatic plates, springs may be provided at an appropriate position at the middle section of the scrapers 47 to ensure that the pressure exerted by the scrapers 47 on the electrostatic plates remains unchanged and to maintain stable scraping effects.

Figure 5:
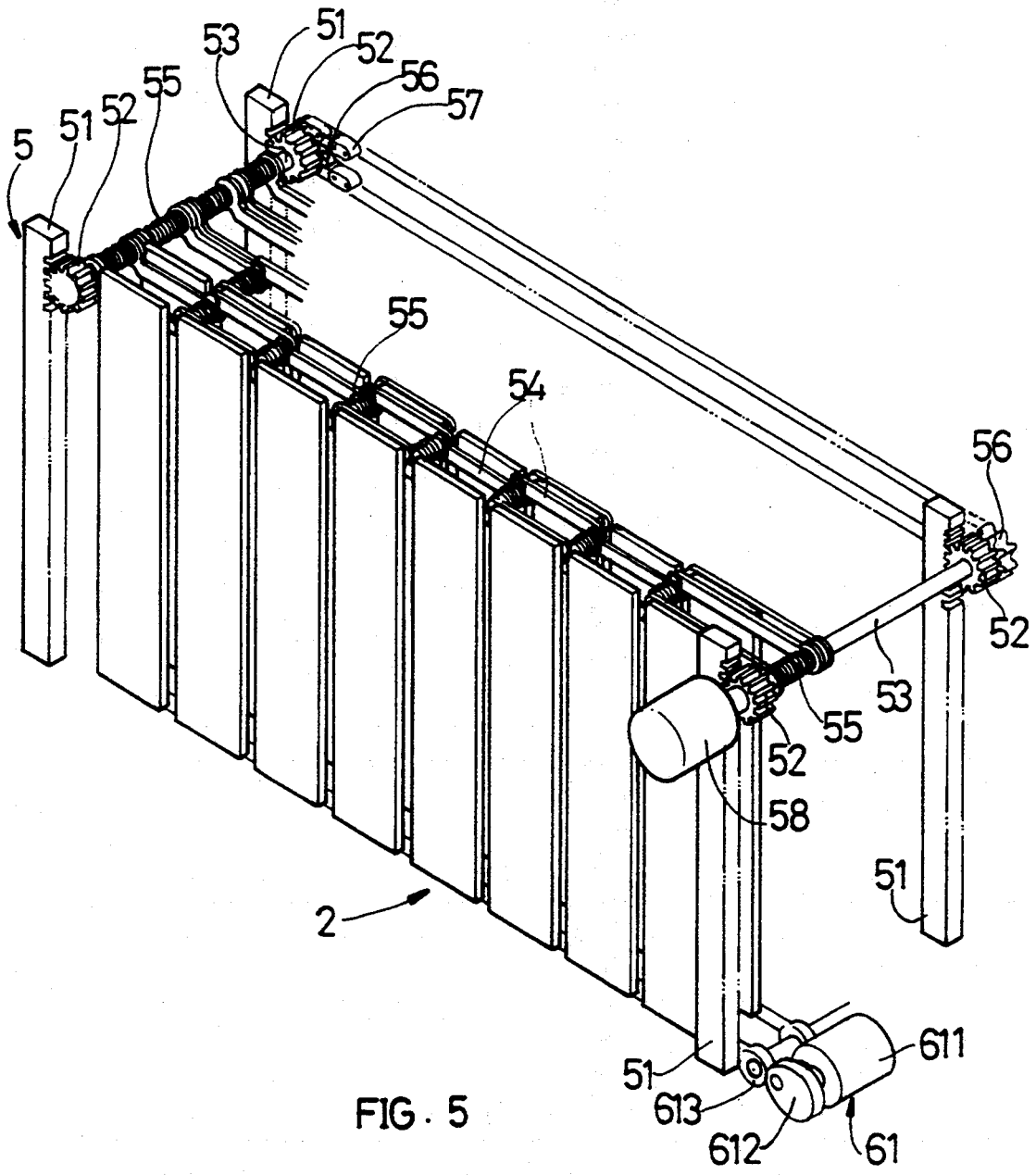
FIG. 5 is a perspective schematic view of the second preferred embodiment of the present invention.

With reference to FIGS. 4 and 5 which show the second preferred embodiment of the present invention, a driving mechanism 5 may have four longitudinal racks 51 disposed at the four corners of the precipitator 2. The teeth of these longitudinal racks 51 face the same direction and mesh with four gears 52 respectively; they are further connected to two gears 52 by means of two driving levers 53. The two driving levers 53 are perpendicular to the electrostatic plates of the precipitator 2. A plurality of scrapers 54 are provided between the two driving levers 53. Each of the scrapers 54 is slightly longer than the width of an electrostatic plate, and its front and rear ends are connected to form a scraper strip. Besides, between the plurality of scrapers 54 between adjacent electrostatic plates, a plurality of springs 55 are respectively stretched therebetween so that the scrapers 47 may press firmly against the electrostatic plates. The gears 52 each on a different axis are respectively provided with a sprocket 56. A chain 57 is wound past the two sprockets 56, and one of the gears 52 is connected to a rotary driving means 58. By means of the rotary driving means 58, a set of coaxial gears 52 connected by a driving lever 53 are caused to rotate, by means of the sprockets 56 which bring a set of coaxial gears 52 connected by another driving lever 53 to rotate in the same direction. In this manner, the two driving levers 53 provided with scrapers 54 may be caused to perform synchronous longitudinal linear displacement to proceed with the work of removing scum on the electrostatic plates.

However, because the scum adhered onto the electrostatic plates are sticky, they may often stick onto the scrapers 54 when being removed from the electrostatic plates by the scrapers 54. Even though some may drop into the collector 3 of their own weight, a portion of the scum may still stick onto the scrapers 54, affecting the scraping efficiency. Therefore, a set of scraping rods 6 is further provided at the bottom end of the electrostatic plates of the precipitator 2. This set of scraping rods 6 gets into contact with the scrapers 54 when the scrapers moves longitudinally downward to the bottom end of the precipitator 2. The set of scraping rods 6 is connected to a driving means 61 which is a motor 611. The motor brings a cam 612 and a push rod 613 to perform linear displacement, further bringing the scraping rods 6 to perform quadrant displacement. Additionally, the displacement area of the scraping rods 6 completely encompasses the area covered by the scrapers 54. Therefore, when the scrapers 54 displace longitudinally and remove the oily scum on the electrostatic plates, some of the oily scum may drop into the collector 3 of their own weight. But the scrapers 54 may still have some residual oily scum stuck thereonto. By actuating the driving means 61 and utilizing the scraping rods 6 which performs quadrant displacement, the residual scum on the scrapers 54 may be removed and collected in the collector 3.

Figure 6:
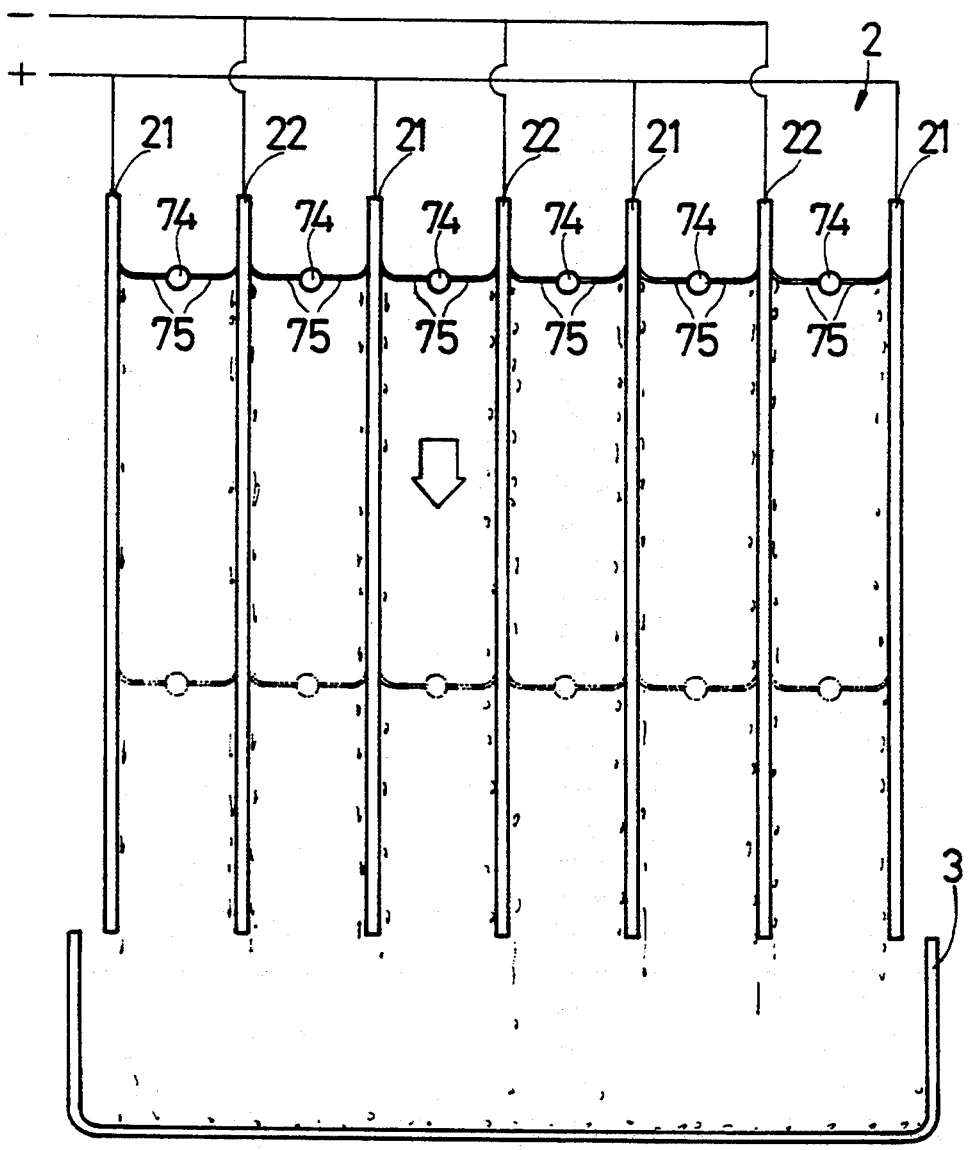
FIG. 6 illustrates the working principle of a third preferred embodiment of the present invention.
Figure 7:
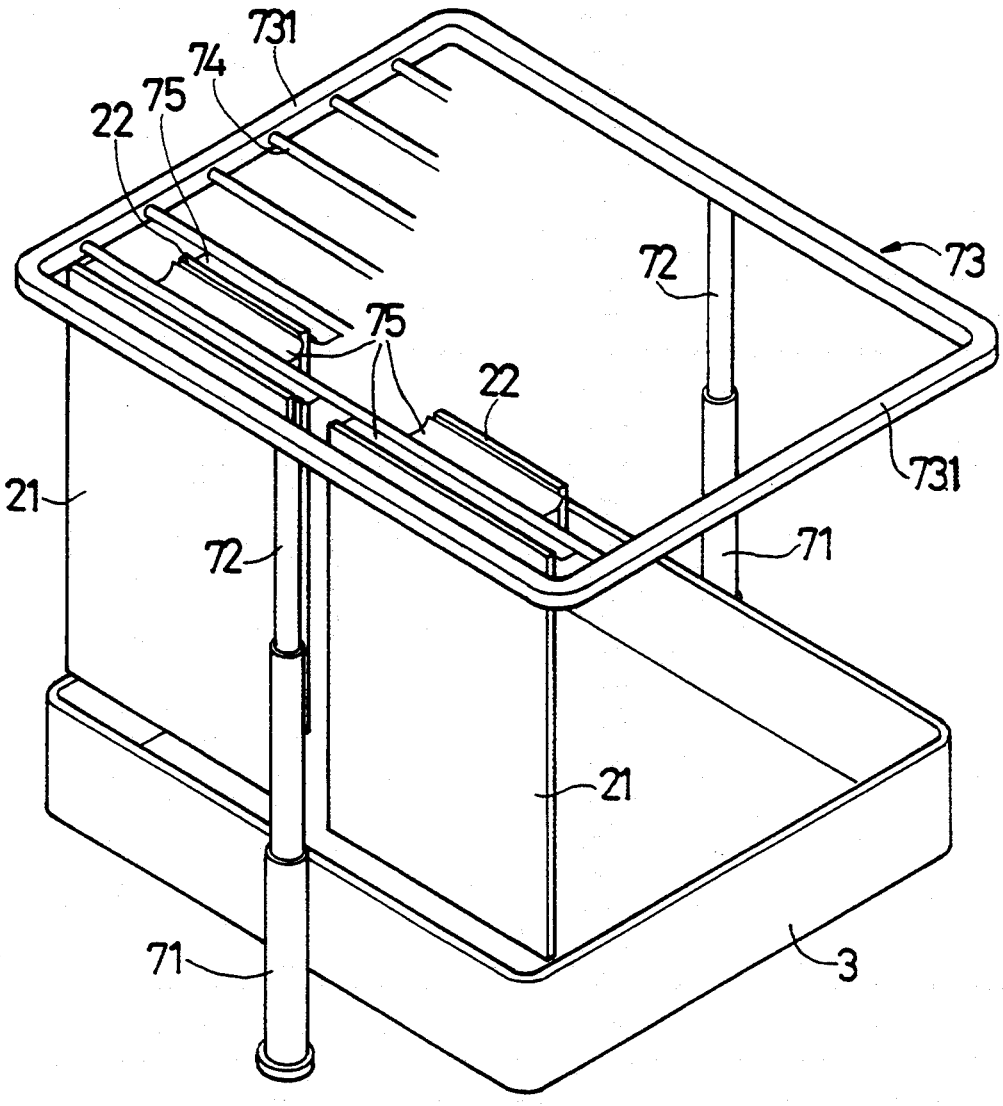
FIG. 7 is a perspective schematic view of the third preferred embodiment of the present invention.

FIGS. 6 and 7 show the third preferred embodiment of the present invention. At both sides of the precipitator 2, two hydraulic cylinders 72 of a driving mechanism 7 are respectively provided. A driving frame 73 is connected to end portions of pistons 72 of the hydraulic cylinders 71. The driving frame 73 is a rectangular frame whose interior area is greater than the cross-sectional area of the precipitator 2. A plurality of scraping rods 74 parallel to the electrostatic plates are provided on two rods 731 of the driving frame 73 and which are perpendicular to the electrostatic plates. Each scraping rod 74 is disposed between the first and second electrostatic plates 21, 22. A scraper 75 is installed on each scraping rod 74. The scraper 75 is a flat plate of a predetermined thickness and its blade is being pressed so that it contacts at least one electrostatic plate. The longitudinal displacement track of the scrapers 75 covers a working area which completely encompasses the working area covered by the electrostatic plates. When the pistons 72 of the two hydraulic cylinders 71 move downward, thus simultaneously bringing the driving frame 73 and the scraping rods 74 to move downward, the scrapers 75 performs longitudinal displacement on the first and second electrostatic plates 21, 22 to remove the oily scum thereon. Because the working track of the scrapers 75 completely encompasses the working area of the first and second electrostatic plates 21, 22, the scrapers 75 may slowly perform longitudinal linear displacement while removing oily scum sticking onto the electrostatic plates. The oily scum may then drop of their own weight and be collected in the collector 3.

There are various embodiments of the present invention with modifications in the details thereof. For instance, three simple embodiments of the driving mechanism are described in the three preferred embodiments and they are used to cause the scrapers to move up and down to remove the oily scum on the electrostatic plates. Obviously, this longitudinal linear motion mechanism may be substituted by many other mechanisms, such as the pulley and cable combination and the crank shaft combination, to achieve similar effects as readily conceivable by those skilled in the art.

In addition, if the scrapers are arranged in such a way as to be pressed against so as to get into contact with the electrostatic plates to remove oily scum, they are preferably made of insulated materials to prevent conduction of electricity.

Furthermore, if the precipitator's length is greater than its height, the scraper may be designed to perform reciprocating linear displacement to remove oily scum on the electrostatic plates.

Certainly, if the oily scum adheres to only the first or second electrostatic plate, the driving levers or the scraping rod may be provided with only one scraper to do the work of removing oily scum.

Also, in order to remove the oily scum from the ion generator's parallel metal plates, a plurality of scrapers for performing reciprocating linear displacement as same as the precipitators' scrapers can be installed on the ion generator.

Although the present invention has been illustrated and described with reference to the preferred embodiment thereof, it should be understood that it is in no way limited to the details of such embodiment but is capable of numerous modifications within the scope of the appended claims.

What is claimed is:

1. A removal device for electrostatic precipitators, said removal device comprising:

an ion generator for supplying electric charge to particles in the air, said ion generator consisting of a plurality of electrodes charged with high voltage direct currents and parallel ground metal plates, in which an air current is introduced from the front of said ion generator into the interior of said ion generator;

a precipitator for arresting particles in the air, in which the air current flows from said ion generator, then passes said precipitator, and finally flows out through the rear portion of said precipitator, said precipitator consisting of at least one pair of a first electrostatic plate and a second electrostatic plate of opposite polarities equally spaced apart and being parallel to each other, in which said first electrostatic plate is connected to one polarity and said second electrostatic plate is connected to another polarity; and a collector for collecting particles in the air, wherein at least a scraper is positioned between adjacent first and second electrostatic plates of said collector, said scraper being parallel to said electrostatic plates with the two ends thereof linked to a vertical driving lever of said electrostatic plates, and said scraper being in contact with an electrostatic plate with a predetermined pressure, said driving lever linking a drive mechanism which drives said driving lever to perform linear displacement.

2. A removal device for electrostatic precipitators as in claim 1, wherein a spring element is provided between said driving lever and two scrapers so that the two ends thereof respectively press against said scrapers so that said scrapers are pressed by said spring elements to press firmly against said electrostatic plates.

3. A removal device for electrostatic precipitators as in claim 1, wherein said driving mechanism consists of four longitudinal racks positioned in four corners of said precipitator, said four longitudinal racks respectively mesh with four gears and connected to two gears by means of two driving levers, said driving levers being perpendicular to said electrostatic plates of said precipitator, and scrapers being provided between said two driving levers, and at least two gears on different axes being respectively provided with a sprocket and a chain being wound past said two sprockets with one of said gears connected to a rotary driving means.

4. A removal device for electrostatic precipitators as in claim 1, wherein a set of scraping rods is provided at the bottom end of said precipitator, said scraping rods being in contact with said scrapers when said scrapers move to the bottom end of said precipitator, said set of scraping levers being connected with a driving means which brings said scraping levers to displace an area which completely encompasses an area covered by said scrapers.

5. A removal device for electrostatic precipitators as in claim 1, wherein said driving mechanism consists of four screws disposed in four corners of said precipitator, said four longitudinal screws being each provided with a sprocket at the bottom end thereof, and a chain being wound past said sprockets of said four longitudinal screws, with one screw connected to a rotary driving means, and nuts being respectively provided at a same level on said longitudinal screws, said nuts being connected to two driving levers perpendicular to said electrostatic plates.

6. A removal device for electrostatic precipitators as in claim 1, wherein said driving mechanism consists of two hydraulic cylinders positioned at both sides of said precipitator, end portions of pistons of said hydraulic cylinders being connected to a driving frame which is a rectangular frame with an interior area greater than a cross-sectional area of said precipitator, a plurality of scraping rods parallel to said electrostatic plates being provided on two rods of said driving frame and being perpendicular to said electrostatic plates, each scraping lever being positioned between said first and second electrostatic plates and being provided with scrapers with blades being pressed against said electrostatic plates to get into contact with at least one electrostatic plate.

7. A removal device for electrostatic precipitators as in claim 6, wherein tips of said blades of said scrapers are pressed and bent and adhere onto said electrostatic plates and the working area covered by said blades completely encompasses the complete area covered by said electrostatic plates.

8. A removal device for electrostatic precipitator as in claim 1, wherein a plurality of scrapers performing reciprocating linear displacement for removing oily scum from the ion generator's parallel metal plates are installed on the ion generator.

* * * * *